US008581184B2

(12) United States Patent
Mizutani

(10) Patent No.: US 8,581,184 B2
(45) Date of Patent: Nov. 12, 2013

(54) QUADRUPOLE MASS SPECTROMETER

(75) Inventor: Shiro Mizutani, Uji (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/639,474

(22) PCT Filed: Mar. 3, 2011

(86) PCT No.: PCT/JP2011/054922
§ 371 (c)(1),
(2), (4) Date: Nov. 26, 2012

(87) PCT Pub. No.: WO2011/125399
PCT Pub. Date: Oct. 13, 2011

(65) Prior Publication Data

US 2013/0234018 A1 Sep. 12, 2013

(30) Foreign Application Priority Data

Apr. 9, 2010 (WO) ..... PCT/JP2010/056432

(51) Int. Cl.
*H01J 49/42* (2006.01)

(52) U.S. Cl.
USPC ..... 250/290; 250/281; 250/283; 250/288; 250/292; 250/293

(58) Field of Classification Search
USPC ..... 250/281, 282, 283, 286, 288, 290, 293
See application file for complete search history.

(56) References Cited

U.S. PATENT DOCUMENTS 6,838,662 B2 * 1/2005 Bateman et al. ..... 250/286
6,884,995 B2 * 4/2005 Bateman et al. ..... 250/281
7,309,861 B2 * 12/2007 Brown et al. ..... 250/290
8,188,426 B2 * 5/2012 Mukaibatake ..... 250/292
8,207,495 B2 * 6/2012 Mukaibatake et al. ..... 250/283
8,445,844 B2 * 5/2013 Mukaibatake et al. ..... 250/292
8,507,852 B2 * 8/2013 Makarov ..... 250/290
2004/0026612 A1 * 2/2004 Bateman et al. ..... 250/281
2013/0175439 A1 * 7/2013 Hoyes ..... 250/282

FOREIGN PATENT DOCUMENTS

JP 2005-259616 9/2005
JP 2007-323838 12/2007

OTHER PUBLICATIONS

Japanese language international preliminary report on patentability dated Oct. 9, 2012 and its English language translation issued in corresponding PCT application PCT/JP2011/054922.

* cited by examiner

*Primary Examiner* — Michael Logie
(74) *Attorney, Agent, or Firm* — Bingham McCutchen LLP

(57) ABSTRACT

Provided is a quadrupole mass spectrometer including direct-current voltage sources having response characteristics which ensure that the response time of the direct-current voltage will be shorter than the period of time required for an ion having the highest mass-to-charge ratio (m/z) among the ions introduced into a quadrupole mass filter to pass through this filter. Main rod electrodes and pre-rod electrodes are connected to each other via primary differentiation circuits. Thus, in the transient state of the voltage change due to the switching of the mass-to-charge ratio, among the ions entering the quadrupole mass filter, ions having low m/z values can be removed by a pre-electrode unit, and ions having high m/z values can be removed by a main electrode unit. Accordingly, a large amount of ions can be prevented from passing through the filter and entering an ion detector.

9 Claims, 5 Drawing Sheets

CONVENTIONAL EXAMPLE

PRESENT INVENTION

QUADRUPOLE MASS SPECTROMETER

TECHNICAL FIELD

The present invention relates to a quadrupole mass spectrometer using a quadrupole mass filter as a mass analyzer for separating ions originating from a sample according to their mass-to-charge ratio (m/z).

BACKGROUND ART

In a normal type of quadrupole mass spectrometer, various kinds of ions created from a sample are introduced into a quadrupole mass filter, which selectively allows only ions having a specific mass-to-charge ratio to pass through it. The selected ions are detected by a detector to obtain an intensity signal corresponding to the amount of ions.

The quadrupole mass filter consists of four rod electrodes arranged parallel to each other around an ion-beam axis, with a voltage composed of a direct-current (DC) voltage and a radio-frequency (RF) voltage (alternating-current voltage) being applied to each of the four rod electrodes. The mass-to-charge ratio of the ions that are allowed to pass through the quadrupole mass filter depends on the RF and DC voltages applied to the rod electrodes. Therefore, it is possible to selectively allow an intended kind of ion to pass through the filter by appropriately setting the RF and DC voltages according to the mass-to-charge ratio of the target ion. Furthermore, when each of the RF and DC voltages applied to the rod electrodes is varied within a predetermined range so that the mass-to-charge ratio of the ion passing through the quadrupole mass filter continuously changes over a predetermined range, a mass spectrum can be created from the signals produced by the detector during this process (the scan measurement).

A detailed description of the voltage applied to the rod electrodes of the quadrupole mass filter is as follows: Among the four rod electrodes, each pair of electrodes facing each other across the ion-beam axis are electrically connected to each other. A voltage $U+V\cdot\cos\Omega t$ is applied to one pair of the electrodes, while a voltage $-U-V\cdot\cos\Omega t$ is applied to the other pair, where $\pm U$ and $\pm V\cdot\cos\Omega t$ are the DC and RF voltages, respectively. A common DC bias voltage, which may additionally be applied to all the rod electrodes, is disregarded in the present discussion since this voltage does not affect the mass-to-charge ratio of the ion that can pass through the filter. In the aforementioned case of changing the mass-to-charge ratio of the target ion over a predetermined range, the voltage value U of the DC voltage and the amplitude value V of the RF voltage are normally controlled so that U and V are individually varied while maintaining the ratio U/V at a constant value (for example, see Patent Document 1). For simplicity, the expressions "DC voltage U" and "RF voltage V" will hereinafter be used in place of the aforementioned, exact expressions of U being the voltage value of the DC voltage and V being the amplitude value of the RF voltage.

In a quadrupole mass spectrometer, when a selective ion monitoring (SIM) measurement is performed, the detection of the ions is sequentially conducted for a plurality of predetermined mass-to-charge ratios. In this process, the mass-to-charge ratio being selected by the quadrupole mass filter may be changed by a significant amount. For example, to change the target ion from a low mass-to-charge ratio $M_L$ to a high mass-to-charge ratio $M_H$, the set values of the DC voltage U and the RF voltage V must be simultaneously changed by a large amount. During this operation, the voltages actually applied to the rod electrodes do not show an ideal, step-like change; they will inevitably have a certain amount of response time (e.g. rise time, fall time and/or delay time). This poses no problem if both the DC and RF voltages have the same response time and similar transient characteristics. Actually, however, the DC and RF voltages have different response times since they are generated by separate circuits. This situation causes the following problems.

FIGS. 7A-7D are model diagrams for illustrating the problem resulting from the difference in response time between the DC voltage U and the RF voltage V.

When the response time t(U) of the DC voltage U is greater than the response time t(V) of the RF voltage V, the voltage change due to the switching operation between the low mass-to-charge ratio $M_L$ and the high mass-to-charge ratio $M_H$ will be as shown in FIG. 7A. In this case, as shown in FIG. 7B, a large amount of ions can pass through the quadrupole mass filter in the transient state during the switching operation from the low mass-to-charge ratio $M_L$ to the high mass-to-charge ratio $M_H$. Conversely, when the response time t(V) of the RF voltage V is greater than the response time t(U) of the DC voltage U, the voltage change during the switching operation between the low mass-to-charge ratio $M_L$ and the high mass-to-charge ratio $M_H$ will be as shown in FIG. 7C, where, as shown in FIG. 7D, a large amount of ions can pass through the quadrupole mass filter in the transient state during the switching operation from the high mass-to-charge ratio $M_H$ to the low mass-to-charge ratio $M_L$.

This phenomenon is hereinafter explained by using FIGS. 8A and 8B, which show stability diagrams based on the stability conditions for the solution of a Mathieu equation.

The stability region S, in which an ion can exist in a stable state in the quadrupole electric field formed in the space surrounded by the rod electrodes (i.e. in which the ion can pass through the quadrupole mass filter without being dispersed halfway), has a nearly triangular shape as shown in FIGS. 8A and 8B. When the mass-to-charge ratio is changed from $M_L$ to $M_H$, the stability region S moves and expands, as shown in FIG. 8A. If the response times t(U) and t(V) are roughly equal (i.e. the voltage ratio U/V is maintained at a substantially constant level), the voltages will change as indicated by the dashed line in FIG. 8A. By contrast, if the change of the DC voltage U is delayed from that of the RF voltage V, the electric field that influences the motion of the ions introduced in the quadrupole mass filter will, in an extreme case, change as indicated by the thick arrowed line in FIG. 8A. In this case, the changing path is largely included in the stability region S, so that ions introduced into the quadrupole mass filter in this transient state can easily pass through this filter without being dispersed.

Conversely, when the mass-to-charge ratio is changed from $M_H$ to $M_L$, the stability region S moves and shrinks, as shown in FIG. 8B. In this case, if the change of the RF voltage V is delayed from that of the DC voltage U, the electric field that influences the motion of the ions introduced in the quadrupole mass filter will, in an extreme case, change as indicated by the thick arrowed line in FIG. 8B. In this case, the changing path is largely included in the stability region S, so that ions introduced into the quadrupole mass filter in this transient state can easily pass through this filter without being dispersed.

If an excessive amount of ions pass through the quadrupole mass filter in the transient state due to the switching of the mass-to-charge ratio, an excessive amount of ions will impinge on the detector, promoting the degradation thereof. In the case of a triple quadrupole (tandem) mass spectrometer having front and rear quadrupole mass filters with a collision cell located in between (for example, see Patent Document 2), if an excessive amount of ions pass through the front quadrupole mass filter, an excessive amount of ions will be retained within the collision cell, which may possibly cause crosstalk, deterioration in the S/N ratio or sensitivity, or other problems.

BACKGROUND ART DOCUMENT

Patent Document

Patent Document 1: JP-A 2007-323838
Patent Document 2: JP-A 2005-259616

SUMMARY OF THE INVENTION

Problem to be Solved by the Invention

The present invention has been developed to solve the previously described problems, and the primary objective thereof is to provide a quadrupole mass spectrometer in which the operation of changing the voltages applied to the rod electrodes forming a quadrupole mass filter so as to switch the mass-to-charge ratio of the target ion will not cause an excessive amount of ions to pass through the filter in the transient state of the voltage-changing process and damage an ion detector or another device in the subsequent stage or deteriorate the accuracy or sensitivity of the analysis.

Means For Solving The Problems

The first aspect of the present invention aimed at solving the previously described problems is a quadrupole mass spectrometer including a quadrupole mass filter having four pre-rod electrodes provided anterior to four main rod electrodes for selectively allowing the passage of an ion originating from a sample according to the mass-to-charge ratio of the ion, the quadrupole mass spectrometer further including:

a) a quadrupole driver including a direct-current voltage source for generating a direct-current voltage whose voltage value changes according to the mass-to-charge ratio of a measurement target, a radio-frequency voltage source for generating a radio-frequency voltage whose amplitude changes according to the mass-to-charge ratio of the measurement target, and a voltage adder for applying, to the main rod electrodes, a voltage produced by adding the direct -current voltage and the radio-frequency voltage, where the response time of the amplitude of the radio-frequency voltage is set to be shorter than the response time of the direct-current voltage when both the radio-frequency voltage and the direct-current voltage are simultaneously changed so as to switch the mass-to-charge ratio of the measurement target, and where the response time of the direct-current voltage is set to be shorter than the period of time required for an ion having the highest mass-to-charge ratio among a target of analysis to pass through the main rod electrodes; and b) a transient voltage supplier for generating, when both the radio-frequency voltage and the direct-current voltage are simultaneously changed so as to switch the mass-to-charge ratio of the measurement target, a voltage corresponding to the transient state of the change of the direct-current voltage and for applying this voltage to the pre-rod electrodes so as to block an ion of a low mass-to-charge ratio that can pass through the main rod electrodes due to the difference in the response time between the radio-frequency voltage and the direct-current voltage while these voltages are being changed.

The second aspect of the present invention aimed at solving the previously described problems is a quadrupole mass spectrometer including a quadrupole mass filter having four post-rod electrodes provided posterior to four main rod electrodes for selectively allowing the passage of an ion originating from a sample according to the mass-to-charge ratio of the ion, the quadrupole mass spectrometer further including:

a) a quadrupole driver including a direct-current voltage source for generating a direct-current voltage whose voltage value changes according to the mass-to-charge ratio of a measurement target, a radio-frequency voltage source for generating a radio-frequency voltage whose amplitude changes according to the mass-to-charge ratio of the measurement target, and a voltage adder for applying, to the main rod electrodes, a voltage produced by adding the direct -current voltage and the radio-frequency voltage, where the response time of the amplitude of the radio-frequency voltage is set to be shorter than the response time of the direct-current voltage when both the radio-frequency voltage and the direct-current voltage are simultaneously changed so as to switch the mass-to-charge ratio of the measurement target, and where the response time of the direct-current voltage is set to be shorter than the period of time required for an ion having the highest mass-to-charge ratio among a target of analysis to pass through the main rod electrodes; and b) a transient voltage supplier for generating, when both the radio-frequency voltage and the direct-current voltage are simultaneously changed so as to switch the mass-to-charge ratio of the measurement target, a voltage corresponding to the transient state of the change of the direct-current voltage and for applying this voltage to the post-rod electrodes so as to block an ion of a low mass-to-charge ratio that can pass through the main rod electrodes due to the difference in the response time between the radio-frequency voltage and the direct-current voltage while these voltages are being changed.

The third aspect of the present invention aimed at solving the previously described problems is a quadrupole mass spectrometer including a quadrupole mass filter having four pre-rod electrodes provided anterior to four main rod electrodes for selectively allowing the passage of an ion originating from a sample according to the mass-to-charge ratio of the ion as well as four post -rod electrodes provided posterior to the main rod electrodes, the quadrupole mass spectrometer further including:

a) a quadrupole driver including a direct-current voltage source for generating a direct-current voltage whose voltage value changes according to the mass-to-charge ratio of a measurement target, a radio-frequency voltage source for generating a radio-frequency voltage whose amplitude changes according to the mass-to-charge ratio of the measurement target, and a voltage adder for applying, to the main rod electrodes, a voltage produced by adding the direct -current voltage and the radio-frequency voltage, where the response time of the amplitude of the radio-frequency voltage is set to be shorter than the response time of the direct-current voltage when both the radio-frequency voltage and the direct-current voltage are simultaneously changed so as to switch the mass-to-charge ratio of the measurement target, and where the response time of the direct-current voltage is set to be shorter than the period of time required for an ion having the highest mass-to-charge ratio among a target of analysis to pass through the main rod electrodes; and b) a transient voltage supplier for generating, when both the radio-frequency voltage and the direct-current voltage are simultaneously changed so as to switch the mass-to-charge ratio of the measurement target, a voltage corresponding to the transient state of the change of the direct -current voltage and for applying this voltage to the pre-rod electrodes and the post-rod electrodes so as to block an ion of a low mass-to-charge ratio that can pass through the main rod electrodes due to the difference in the response time between the radio-frequency voltage and the direct-current voltage while these voltages are being changed.

In one mode of any of the first through third aspects of the present invention, the transient voltage supplier is a differentiation circuit, such as a capacitor-resistor (CR) differentiation circuit. A differentiation circuit outputs a higher voltage for a greater temporal change in a direct-current voltage, and the output voltage decreases as the temporal change becomes slower. Thus, this device can produce a voltage corresponding to a voltage difference which transiently occurs due to the difference in the response time between the direct-current voltage and the radio-frequency voltage. A CR differentiation circuit is particularly preferable since it is simple structured, inexpensive and hence causes no significant increase in the device cost.

In the case of using the CR differentiation circuit, its low-frequency cutoff f is $f=1/(2\pi\tau)$, where $\tau(=RC)$ is the time constant of the circuit. If the frequency characteristic f(U) of the change of the direct-current voltage during the operation of switching the mass-to-charge ratio is lower than the low-frequency cutoff f, the change in the direct-current voltage cannot pass through the differentiation circuit, so that the voltage for blocking an ion of a low mass-to-charge ratio cannot be applied to the pre-rod or post-rod electrodes. When the relation between the time constant $\tau$ of the differentiation circuit and the response time t(U) of the direct-current voltage is $t=t(U)/3$, the frequency characteristic of the change of the direct-current voltage is $f(U)=1/(2\pi\tau)$. Accordingly, in order that the change in the direct-current voltage can pass through the differentiation circuit, it is preferable to set the time constant $\tau$ of the differentiation circuit to be greater than one third of the response time t(U) of the direct-current voltage generated by the direct-current power source.

In the quadrupole mass spectrometer according to any of the first through third aspects of the present invention, when the mass-to-charge ratio of the measurement target is switched, both the radio-frequency voltage and the direct-current voltage applied from the quadrupole driver to the main rod electrodes are simultaneously changed according to the mass-to-charge ratio. During the transient state of changing these voltages, a voltage corresponding to the transient state is applied to one or both of the pre-rod and post-rod electrodes by the transient voltage supplier. This temporary application of the voltage creates a temporary direct-current quadrupole electric field in either a space surrounded by the pre-rod electrodes or a space surrounded by the post-rod electrodes, or both. For example, a quadrupole electric field created in the space surrounded by the pre-rod electrodes affects the ions entering the pre-rod electrodes so as to specifically disperse such ions that belong to a low mass-to-charge ratio range, thus dissipating these ions before they reach the main rod electrodes. A quadrupole electric field created in the space surrounded by the post-rod electrodes affects the ions entering the post-rod electrodes so as to specifically disperse such ions that belong to a low mass-to-charge ratio range, thus dissipating these ions before they reach an ion detector, a collision cell or any other device located posterior to the post-rod electrodes.

An ion having a relatively high mass-to-charge ratio and hence requiring a period of time longer than the response time of the direct-current voltage to pass through the space surrounded by the main rod electrodes is removed by the electric field created in the space surrounded by the main rod electrodes. Thus, among the ions entering the quadrupole mass filter in the transient state of the voltage change due to the switching of the mass-to-charge ratio (to be exact, the switching operation from a low mass-to-charge ratio to a high mass-to-charge ratio), both the ions belonging to the low mass-to-charge ratio range and those belonging to the high mass-to-charge ratio range can be decreased, so that the amount of ions passing through the quadrupole mass filter will be reduced.

Effect of the Invention

When the quadrupole mass spectrometer according to any of the first through third aspects of the present inventions is constructed as a normal quadrupole mass spectrometer having an ion detector posterior to the quadrupole mass filter, it is possible to prevent an unintended entry of a large amount of ions into the ion detector in the transient state due to the switching of the mass-to-charge ratio of the target ion. This limits damage to the ion detector, such as an electron multiplier. When the quadrupole mass spectrometer according to any of the first through third aspects of the present inventions is constructed as a triple quadrupole mass spectrometer having a collision cell posterior to the anterior quadrupole mass filter, it is possible to prevent an unintended entry of a large amount of ions into the collision cell in the transient state due the switching of the mass-to-charge ratio of the precursor ion to be analyzed. This prevents the occurrence of ghost peak due to the unintended ions remaining in the collision cell, thus helping to improve the SIN ratio or the sensitivity of the detection signal.

BEST MODE FOR CARRYING OUT THE INVENTION

Figure 1:
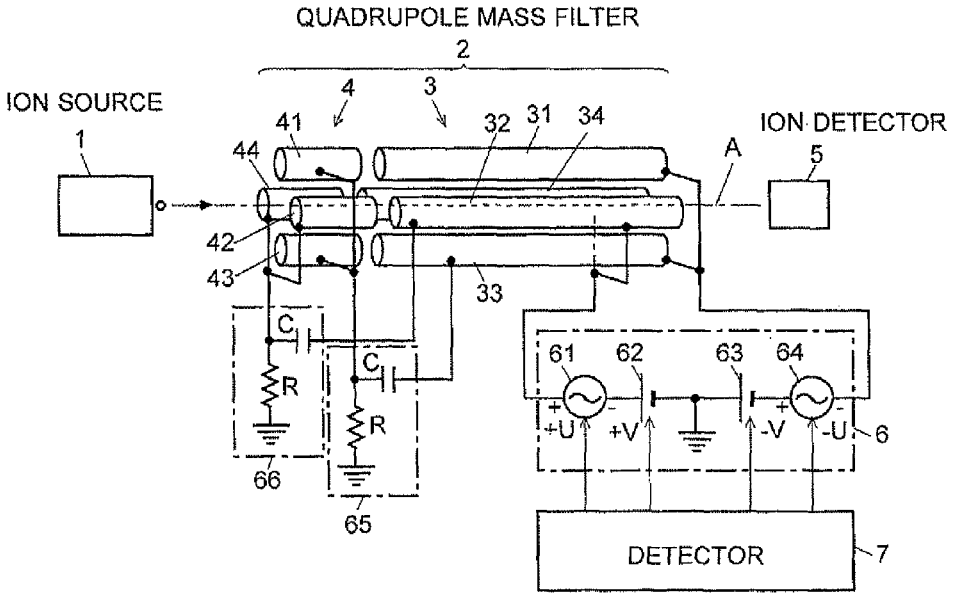
FIG. 1 is a schematic configuration diagram of a quadrupole mass spectrometer according to one embodiment of the present invention.

One embodiment of the quadrupole mass spectrometer according to the present invention is hereinafter described with reference to the attached drawings. FIG. 1 is a schematic configuration diagram of the quadrupole mass spectrometer of the present embodiment.

Various kinds of ions generated from a sample in an ion source 1 pass through a quadrupole mass filter 2, which consists of a main electrode unit 3 and a pre-electrode unit 4, and reach an ion detector 5. The main electrode unit 3 includes four main rod electrodes 31, 32, 33 and 34 arranged parallel to each other and being in contact with the inner surface of a cylinder having a predetermined radius with its center lying on an ion-beam axis A. The pre-electrode unit 4 consists of four pre-rod electrodes 41, 42, 43 and 44 which are identical to the electrodes of the main electrode unit 3 in terms of arrangement but shorter than the latter electrodes.

In the main electrode unit 3, each pair of the main rod electrodes facing each other across the ion-beam axis A, i.e. the electrodes 31 and 33 or 32 and 34, are electrically connected to each other. Under the control of a controller 7, a predetermined voltage is applied from a quadrupole voltage generator 6 to each pair of the main rod electrodes 31-34. Similarly, in the pre-electrode unit 4, each pair of the pre-rod electrodes facing each other across the ion-beam axis A, i.e. the electrodes 41 and 43 or 32 and 44, are electrically connected to each other. The main rod electrodes 31 and 33 are connected to the pre-rod electrodes 41 and 43 via a primary differentiation filter circuit 65, while the main rod electrodes 32 and 34 are connected to the pre-rod electrodes 42 and 44 via another primary differentiation filter circuit 66.

The quadrupole voltage generator 6 includes direct-current (DC) voltage sources 62 and 63, which generate two direct currents $\pm U$ with opposite polarities, and radio-frequency (RE) voltage sources 61 and 64, which generate alternating-current voltages $\pm V\cdot\cos\Omega t$ with a phase difference of 180 degrees. The two types of voltages are respectively synthesized to generate two driving voltages $+(U+V\cdot\cos\Omega t)$ and $-(U+V\cdot\cos\Omega t)$. Each of the primary differentiation filter circuits 65 and 66 consists of a resistor R and a capacitor C, with the time constant of the filter being $\tau=RC$[s]. The low-frequency cutoff of these primary differentiation filter circuits 65 and 66 is $1/(2\pi\tau)$.

In FIG. 1, for ease of explanation, the wire between the two DC voltage sources 62 and 63 in the quadrupole voltage generator 6 is connected to the ground. Alternatively, a common DC bias voltage may be given to this wire in place of the ground potential (0V). In this case, it is preferable to also give the common DC bias voltage to one end of the resistor R in each of the primary differentiation filter circuits 65 and 66 in place of the ground potential (0V).

Though not shown in FIG. 1 to avoid complication, an ion transport optical system, such as an ion lens or ion guide, for converging ions, and for accelerating or decelerating them in some cases, is actually provided between the ion source I and the quadrupole mass filter 2.

Figure 7A:
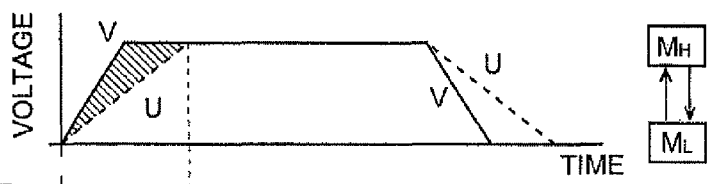
FIGS. 7A-7D are diagrams for illustrating the problem resulting from the difference in response time between the direct-current voltage and the radio-frequency voltage.
Figure 7B:
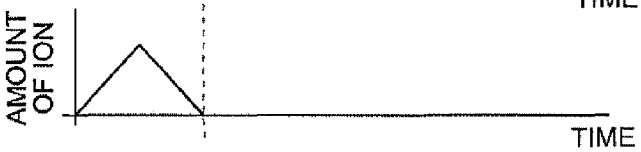
Figure 7C:
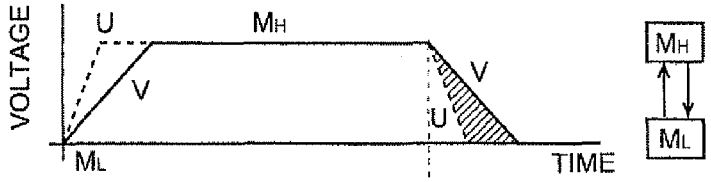
Figure 7D:
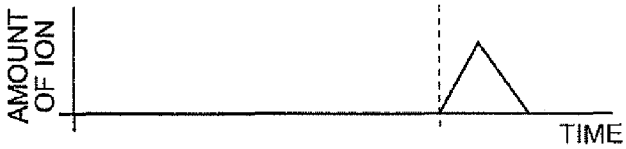
Figure 8A:
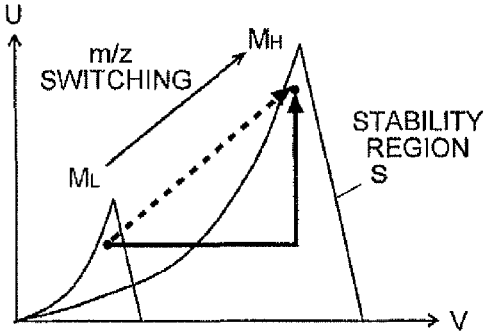
FIGS. 8A and 8B are diagrams illustrating the problem of FIGS. 7A and 7B by using stability diagrams based on the stability conditions of the solution of a Mathieu equation.
Figure 8B:
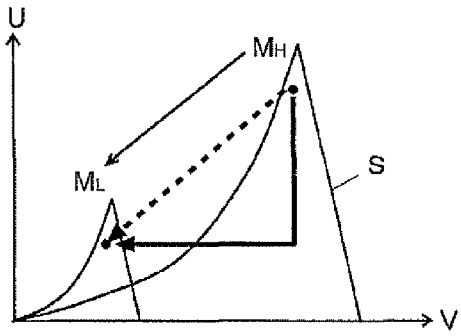

In the quadrupole mass spectrometer of the present embodiment, when the mass-to-charge ratio of the ion to be selected in (or to be allowed to pass through) the main electrode unit 3 is to be switched, the driving voltages $\pm(U+V\cdot\cos\Omega t)$ are changed. The response time t(U) of the DC voltage U and the response time t(V) of the RF voltage V should preferably be equal to each other, although it is practically difficult to make them perfectly equal to each other. The DC voltage sources 62 and 63 normally include a DC amplifier, and a capacitor of a relatively large capacitance is connected to the output thereof to stabilize the output voltage. The main rod electrodes 31-34 themselves also act as capacitive loads. Due to the necessity of charging and discharging these capacitive loads, the response time t(U) of the DC voltage U becomes longer than the response time t(V) of the RF voltage V. As a result, as shown in FIG. 7A, the problem of the increase in the amount of passing ions arises in the operation of switching from a low mass-to-charge ratio to a high mass-to-charge ratio.

To decrease the amount of passing ions under the previously described condition, the quadrupole voltage generator 6 and the primary differentiation filter circuits 65 and 66 in the quadrupole mass spectrometer of the present embodiment have characteristic configurations as follows.

(1) The DC voltage sources 62 and 63 have response characteristics which ensure that the response time t(U) of the DC voltage will be shorter than the period of time required for an ion having the highest mass-to-charge ratio among the ions introduced into the quadrupole mass filter 2 to pass through this filter 2.

Figure 2:
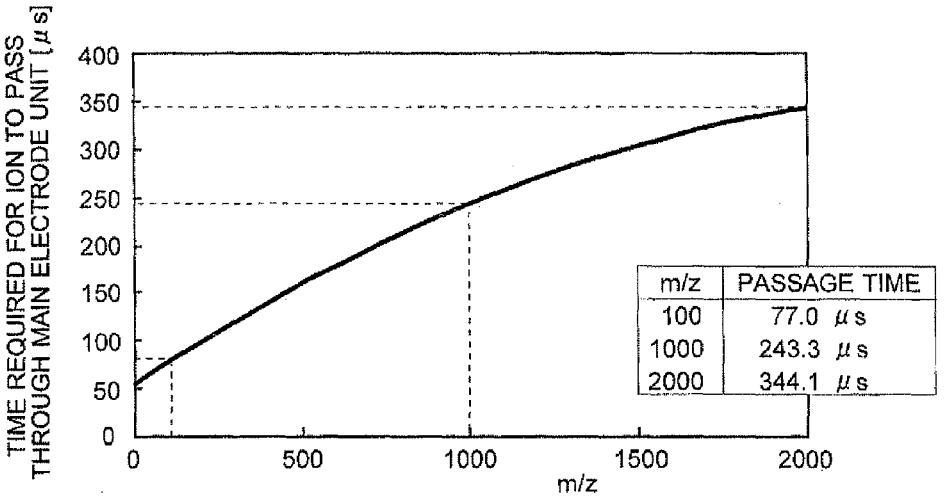
FIG. 2 is a graph showing one example of the relationship between the mass-to-charge ratios of ions and the periods of time for the ions to pass through a quadrupole mass filter.

FIG. 2 is a graph showing one example of the relationship between the mass-to-charge ratio of the ions and the required period of time for the passage of the ions in the main electrode unit 3 of the quadrupole mass filter 2 used in the present embodiment. For example, the period of time required for the passage of an ion having a mass-to-charge ratio (m/z) of 1,000 is 243.3 [μs], and the period of time required for the passage of an ion having a mass-to-charge ratio (m/z) of 2,000 is 344.1 [μs]. In principle, any ion that has a high mass-to-charge ratio and accordingly requires a longer passage time than the response time of either the DC voltage U or the RF voltage V, whichever shorter, will be dissipated while passing through the main electrode unit 3 and therefore cannot complete the passage. Accordingly, for example, when the response time t(U) of the DC voltage is set to 243.3 [μs], any ion having a mass-to-charge ratio of 1,000 or greater will be removed in the transient state of the voltage change. Shortening the response time t(U) of the DC voltage U decreases the lower limit of the mass-to-charge ratio of the ions that can be removed by the main electrode unit 3.

(2) The values of the resistance R and capacitor C in the primary differentiation filter circuit 65 and 66 are chosen so that the thereby determined time constant $\tau$ will be greater than one third of the response time t(U) of the DC voltage U.

The primary differentiation filter circuits 65 and 66 are low-frequency cutting filters. Its low-frequency cutoff is $f=1/(2\pi\tau)$. On the assumption that the time constant $\tau=t(U)/3$, the frequency characteristic of the fluctuation of the DC voltage U is expressed as $f(U)=1/(2\pi\tau)$. If $\tau<t(U)/3$, then $f(U)<f$. Under this condition, the change in the DC voltage due to the switching of the mass-to-charge ratio cannot pass through the primary differentiation filter circuits 65 and 66, which means that no voltage will be applied to the pre-rod electrodes 41-44. To avoid this problem, the aforementioned condition has been adopted so that the change in the DC voltage U due to the switching of the mass-to-charge ratio can pass through the primary differentiation filter circuits 65 and 66.

Figure 3:
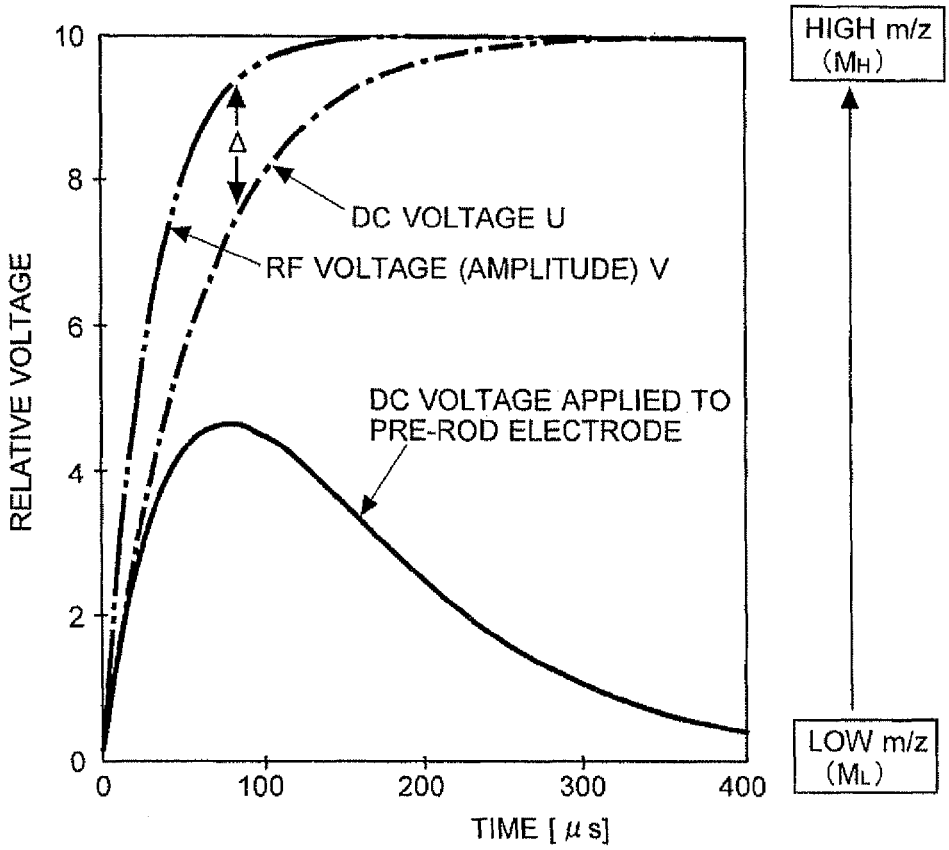
FIG. 3 is a graph showing the result of observations of voltage changes in the operation of switching the mass-to-charge ratio in the quadruple mass spectrometer of the present embodiment.

Specifically, in the quadrupole mass spectrometer of the present embodiment, the response time t(V) of the RF voltage V generated by the RF voltage sources 61 and 64 is set to 100 [μs], the response time t(U) of the DC voltage U generated by the DC voltage sources 62 and 63 is set to 200 [μs], and the time constant $\tau$ of the primary differentiation filter circuit 65 and 66 is set to 100 [μs]. FIG. 3 is a graph showing the result of observations of a change of the RF voltage, a change of the DC voltage, and a change of the voltage applied to the pre-rod electrodes 41-44 through the primary differentiation filter circuits 65 and 66 during the switching operation from a low mass-to-charge ratio (m/z10) to a high mass-to-charge ratio (m/z1000), The vertical axis indicates the relative value of the voltages.

The difference A in the amount of change between the RF voltage V and the DC voltage is the cause of the passage of an excessive amount of ions through the quadrupole mass filter 32 in the transient state of the voltage change. From FIG. 2, it can be understood that, under the aforementioned conditions of the response times t(U) and t(V), any ion having a mass-to-charge ratio of approximately 750 or higher can be removed by the main electrode unit 3. In other words, ions having a mass-to-charge ratio of approximately 750 or lower cannot be removed by the main electrode unit 3. However, in the transient state of the voltage change, a voltage as shown in FIG. 3 is applied to the pre-rod electrodes 41-44, whereby a DC magnetic field is temporarily created in the space surrounded by the pre-rod electrodes 41-44. Among the ions entering this electric field, light ions, i.e. ions with lower mass-to-charge ratios, are more likely to have their flight path bent due to the influence from the electric field. Thus, ions having low mass-to-charge ratios are dissipated when passing through the pre-rod electrodes 41-44.

That is to say, in the transient state of the voltage change due to the switching of the mass-to-charge ratio, ions having relatively low mass-to-charge ratios are removed by the pre-electrode unit 4, while ions having relatively high mass-to-charge ratios are removed by the main electrode unit 3. Thus, the amount of ions that completely pass through the quadrupole mass filter 2 in the transient state is dramatically reduced.

Figure 4A:
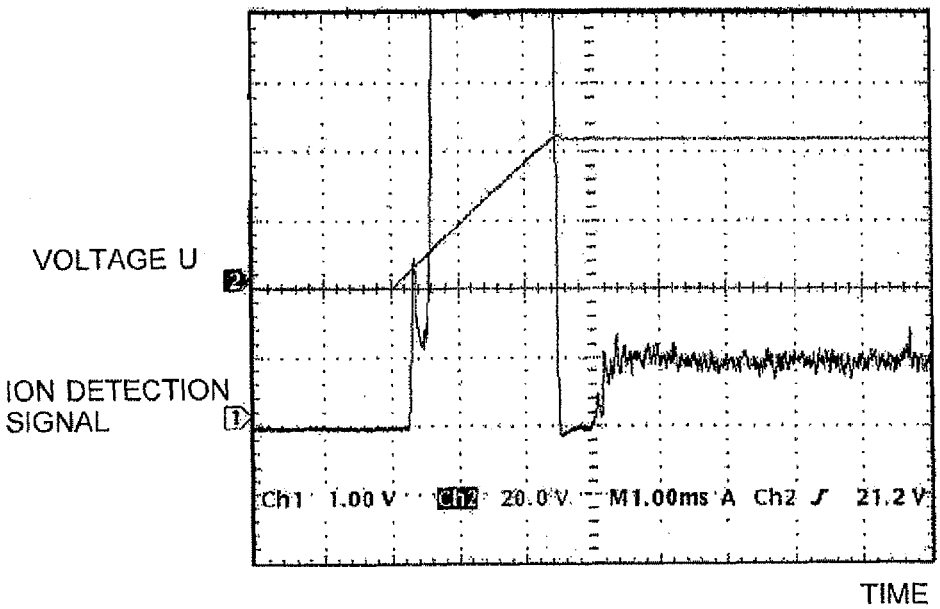
FIGS. 4A and 4B are graphs showing the results of observations of a change in the direct -current voltage and the ion detection signal.
Figure 4B:
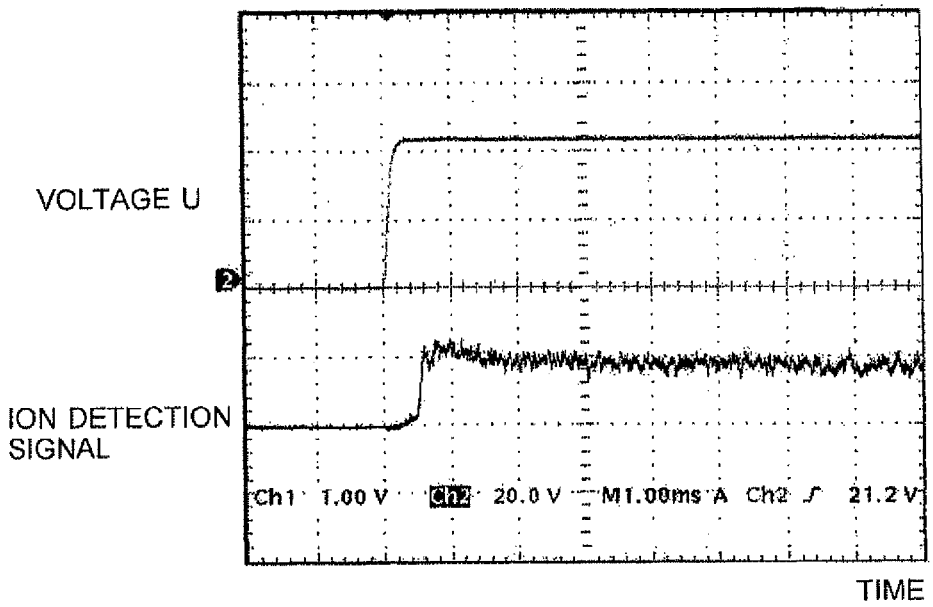

FIGS. 4A and 4B are graphs showing the results of measurements of an intensity signal obtained with the ion detector 5 when the mass-to-charge ratio was switched in an actual device. FIG. 4B shows the measurement result of the previously described embodiment, with t(U), t(V) and $\tau$ set to the aforementioned values. FIG. 4A is the measurement result obtained by a conventional system, with the parameter settings of t(U)=1.5 [ms], t(V)=100 [μs] and $\tau$=700 [μs]. The mass-to-charge ratio range of the target ions was roughly from m/z20 to m/z2000. From FIG. 2, it can be understood that t(U)=1.5 [ms] does not satisfy the previously described condition (1). Therefore, in the result of FIG. 4A obtained by the conventional system, the ion intensity extremely increases in the transient state of the voltage change. This will probably cause serious damage to the ion detector. By contrast, in the result of FIG. 4A obtained by the present embodiment, the ion intensity in the transient state of the voltage change is extremely low. These results confirm the ion-suppressing effect of the present invention.

Figure 5:
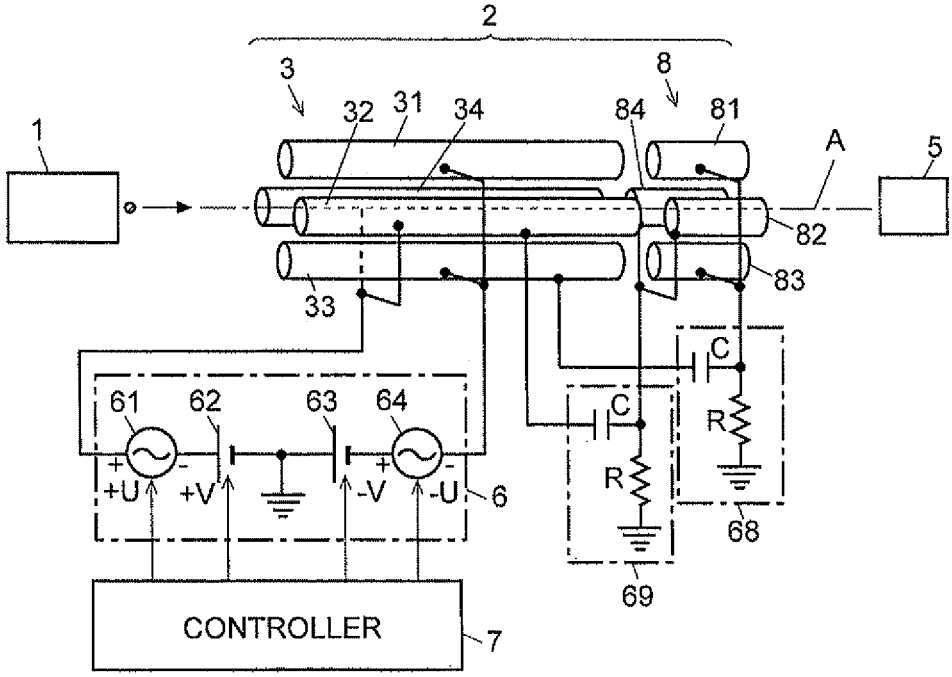
FIG. 5 is a schematic configuration diagram of a quadrupole mass spectrometer according to another embodiment of the present invention.
Figure 6:
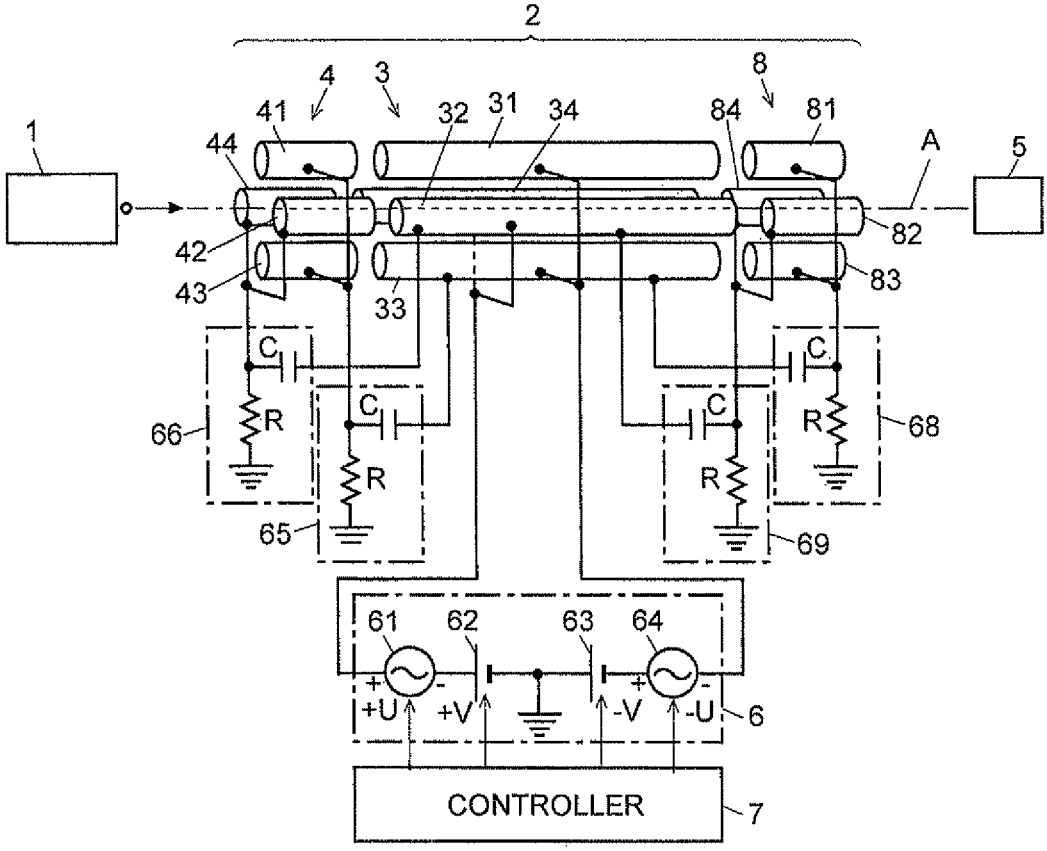
FIG. 6 is a schematic configuration diagram of a quadrupole mass spectrometer according to still another embodiment of the present invention.

In the quadrupole mass spectrometer of the previous embodiment, the quadrupole mass filter 2 had the pre-electrode unit 4 provided anterior to the main electrode unit 3. Other designs of the quadrupole mass filter are also commonly known, such as the one having a post-electrode unit provided posterior to the main electrode unit, or having both the pre-electrode unit and the post-electrode unit. It is evident that the present invention is also applicable to these types of quadrupole mass filters. FIGS. 5 and 6 are schematic configuration diagrams showing quadrupole mass spectrometers according to other embodiments of the present invention. In each of these figures, the same components as shown in FIG. 1 are denoted by the same numerals.

The quadrupole mass spectrometer shown in FIG. 5 has a post-electrode unit 8 provided posterior to the main electrode unit 3 in the quadrupole mass filter 2. Similar to the pre-electrode unit 4 shown in FIG. 1, the post-electrode unit 8 consists of four post-rod electrodes 81, 82, 83 and 84 which are identical to the electrodes of the main electrode unit 3 in terms of arrangement but shorter than the latter electrodes. Each pair of the post-rod electrodes facing each other across the ion-beam axis A, i.e. the electrodes 81 and 83 or 82 and 84, are electrically connected to each other. The main rod electrodes 31 and 33 are respectively connected to the post-rod electrodes 81 and 83 via a primary differentiation filter circuit 68. Similarly, the main rod electrodes 32 and 34 are respectively connected to the post-rod electrodes 82 and 84 via another primary differentiation filter circuit 69. Thus, similar to the pre-electrode unit 4 of the previous embodiment, the post-electrode unit 8 is capable of removing ions having relatively low mass-to-charge ratios and thereby preventing an excessive amount of ions from reaching the ion detector 5.

In the quadrupole mass spectrometer shown in FIG. 6, the quadrupole mass filter 2 has both the pre-electrode unit 4 anterior to the main electrode unit 3 and the post-electrode unit 8 posterior to the main electrode unit 3. The structure of the pre-electrode unit 4 and as the connections between the pre-electrode unit 4 and the main electrode unit 3 via the primary differentiation filter circuits 65 and 66 are the same as in FIG. 1. The structure of the post-electrode unit 8 and the connections between the post-electrode unit 8 and the main electrode unit 3 via the primary differentiation filter circuits 68 and 69 are the same as in FIG. 5. In this embodiment, both the pre-electrode unit 4 and the post-electrode unit 8 are respectively capable of removing ions having relatively low mass-to-charge ratios. Accordingly, as compared to the systems shown in FIGS. 1 and 5, the present system can more effectively remove ions having relatively low mass-to-charge ratios and more assuredly prevent an excessive amount of ions from reaching the ion detector 5.

The configurations of FIGS. 5 and 6 also allow a common DC bias voltage to be given to the wire between the two DC voltage sources 62 and 63 in the quadrupole voltage generator 6 in place of the ground potential. In this case, it is preferable to also give the common DC bias voltage to one end of the resistor R in each of the primary differentiation filter circuits 65, 66, 68 and 69.

It should be noted that the previous embodiments are mere examples of the present invention, and any change, addition or modification appropriately made within the spirit of the present invention will evidently fall within the scope of claims of this patent application.

For example, as opposed to the previous embodiments in which the present invention was applied to a normal type of quadrupole mass spectrometer, it is possible to create a triple quadrupole mass spectrometer in which a quadrupole mass filter having any of the structures described in the previous embodiments is adopted as the front quadrupole mass filter so as to prevent an excessive amount of ions from being introduced into the collision cell in the transient state due to the switching of the mass-to-charge ratio to be selected by the front quadrupole mass filter.

Explanation Of Numerals

1 . . . Ion Source
2 . . . Quadrupole Mass Filter
3 . . . Main Electrode Unit
31-34 . . . Main Rod Electrode
4 . . . Pre-Electrode Unit
41-44 . . . Pre-Rod Electrode
5 . . . Detector
6 . . . Quadrupole Voltage Generator
61 and 64 . . . Radio-Frequency Voltage
62 and 63 . . . Direct-Current Voltage
65, 66, 68 and 69 . . . Primary differentiation Filter Circuit

7 . . . Controller
8 . . . Post-Electrode Unit
81-84 . . . Post-Rod Electrode
A . . . Ion-Beam Axis
C . . . Capacitor
R . . . Resistor

The invention claimed is:

1. A quadrupole mass spectrometer including a quadrupole mass filter having four pre-rod electrodes provided anterior to four main rod electrodes for selectively allowing a passage of an ion originating from a sample according to a mass-to-charge ratio of the ion, comprising:

a) a quadrupole driver including a direct-current voltage source for generating a direct-current voltage whose voltage value changes according to the mass-to-charge ratio of a measurement target, a radio-frequency voltage source for generating a radio-frequency voltage whose amplitude changes according to the mass-to-charge ratio of the measurement target, and a voltage adder for applying, to the main rod electrodes, a voltage produced by adding the direct-current voltage and the radiofrequency voltage, where a response time of the amplitude of the radio-frequency voltage is set to be shorter than a response time of the direct-current voltage when both the radio-frequency voltage and the direct-current voltage are simultaneously changed so as to switch the mass-to-charge ratio of the measurement target, and where the response time of the direct-current voltage is set to be shorter than a period of time required for an ion having a highest mass-to-charge ratio among a target of analysis to pass through the main rod electrodes; and b) a transient voltage supplier for generating, when both the radio-frequency voltage and the direct-current voltage are simultaneously changed so as to switch the mass-to-charge ratio of the measurement target, a voltage corresponding to a transient state of the change of the direct-current voltage and for applying this voltage to the pre-rod electrodes so as to block an ion of a low mass-to-charge ratio that can pass through the main rod electrodes due to a difference in the response time between the radio-frequency voltage and the direct-current voltage while these voltages are being changed.

2. The quadrupole mass spectrometer according to claim 1, wherein the transient voltage supplier is a differentiation circuit.

3. The quadrupole mass spectrometer according to claim 2, wherein a time constant of the differentiation circuit is set to be greater than one third of a response time of the direct-current voltage generated by the direct-current power source.

4. A quadrupole mass spectrometer including a quadrupole mass filter having four post-rod electrodes provided posterior to four main rod electrodes for selectively allowing a passage of an ion originating from a sample according to a mass-to-charge ratio of the ion, comprising:

a) a quadrupole driver including a direct-current voltage source for generating a direct-current voltage whose voltage value changes according to a mass-to-charge ratio of a measurement target, a radio-frequency voltage source for generating a radio-frequency voltage whose amplitude changes according to the mass-to-charge ratio of the measurement target, and a voltage adder for applying, to the main rod electrodes, a voltage produced by adding the direct-current voltage and the radio-frequency voltage, where a response time of the amplitude of the radio-frequency voltage is set to be shorter than a response time of the direct-current voltage when both the radio-frequency voltage and the direct-current voltage are simultaneously changed so as to switch the mass-to-charge ratio of the measurement target, and where the response time of the direct-current voltage is set to be shorter than a period of time required for an ion having a highest mass-to-charge ratio among a target of analysis to pass through the main rod electrodes; and b) a transient voltage supplier for generating, when both the radio-frequency voltage and the direct-current voltage are simultaneously changed so as to switch the mass-to-charge ratio of the measurement target, a voltage corresponding to a transient state of the change of the direct-current voltage and for applying this voltage to the post-rod electrodes so as to block an ion of a low mass-to-charge ratio that can pass through the main rod electrodes due to a difference in the response time between the radio-frequency voltage and the direct-current voltage while these voltages are being changed.

5. The quadrupole mass spectrometer according to claim 4, wherein the transient voltage supplier is a differentiation circuit.

6. The quadrupole mass spectrometer according to claim 5, wherein a time constant of the differentiation circuit is set to be greater than one third of a response time of the direct-current voltage generated by the direct-current power source.

7. A quadrupole mass spectrometer including a quadrupole mass filter having four pre-rod electrodes provided anterior to four main rod electrodes for selectively allowing a passage of an ion originating from a sample according to a mass-to-charge ratio of the ion as well as four post-rod electrodes provided posterior to the main rod electrodes, comprising:

a) a quadrupole driver including a direct-current voltage source for generating a direct-current voltage whose voltage value changes according to a mass-to-charge ratio of a measurement target, a radio-frequency voltage source for generating a radio-frequency voltage whose amplitude changes according to the mass-to-charge ratio of the measurement target, and a voltage adder for applying, to the main rod electrodes, a voltage produced by adding the direct-current voltage and the radio-frequency voltage, where a response time of the amplitude of the radio-frequency voltage is set to be shorter than a response time of the direct-current voltage when both the radio-frequency voltage and the direct-current voltage are simultaneously changed so as to switch the mass-to-charge ratio of the measurement target, and where the response time of the direct-current voltage is set to be shorter than a period of time required for an ion having a highest mass-to-charge ratio among a target of analysis to pass through the main rod electrodes; and b) a transient voltage supplier for generating, when both the radio-frequency voltage and the direct-current voltage are simultaneously changed so as to switch the mass-to-charge ratio of the measurement target, a voltage corresponding to a transient state of the change of the direct-current voltage and for applying this voltage to the pre-rod electrodes and the post-rod electrodes so as to block an ion of a low mass-to-charge ratio that can pass through the main rod electrodes due to a difference in the response time between the radio-frequency voltage and the direct-current voltage while these voltages are being changed.

8. The quadrupole mass spectrometer according to claim 7, wherein the transient voltage supplier is a differentiation circuit.

9. The quadrupole mass spectrometer according to claim 8, wherein a time constant of the differentiation circuit is set to be greater than one third of a response time of the direct-current voltage generated by the direct-current power source.

* * * * *